US007377742B2

(12) United States Patent
Shapiro et al.

(10) Patent No.: US 7,377,742 B2
(45) Date of Patent: May 27, 2008

(54) TURBINE SHROUD ASSEMBLY AND METHOD FOR ASSEMBLING A GAS TURBINE ENGINE

(75) Inventors: Jason David Shapiro, Methuen, MA (US); Daniel Demers, Ipswich, MA (US); Robert Patrick Tameo, Peabody, MA (US); Tyler F. Hooper, Amesbury, MA (US); Robert Alexander Nicoll, Beverly, MA (US); Douglas Patrick Probasco, Peabody, MA (US)

(73) Assignee: General Electric Company, Schenectady, NY (US)

( * ) Notice: Subject to any disclaimer, the term of this patent is extended or adjusted under 35 U.S.C. 154(b) by 183 days.

(21) Appl. No.: 11/250,660

(22) Filed: Oct. 14, 2005

(65) Prior Publication Data

US 2007/0086883 A1 Apr. 19, 2007

(51) Int. Cl.
*F01D 25/26* (2006.01)

(52) U.S. Cl. ..... 415/108; 415/115; 415/182.1

(58) Field of Classification Search ..... 415/115, 415/182.1, 108, 139
See application file for complete search history.

(56) References Cited

U.S. PATENT DOCUMENTS 3,583,824 A 6/1971 Smuland et al.
4,251,185 A 2/1981 Karstensen
4,332,523 A 6/1982 Smith
4,573,866 A 3/1986 Sandy, Jr. et al.
5,088,888 A * 2/1992 Bobo ..... 415/170.1
5,161,944 A 11/1992 Wood
6,491,093 B2 * 12/2002 Kreis et al. ..... 165/169
6,733,233 B2 5/2004 Jasklowski et al.
6,761,534 B1 7/2004 Willett
6,848,885 B1 2/2005 Maclean
6,925,814 B2 8/2005 Wilson et al.
6,942,445 B2 9/2005 Morris et al.

* cited by examiner

*Primary Examiner*—Edward Look
*Assistant Examiner*—Dwayne J White
(74) *Attorney, Agent, or Firm*—William Scott Andes, Esq.; Armstrong Teasdale LLP

(57) ABSTRACT

A method for assembling a gas turbine engine includes coupling a rotor assembly including a plurality of rotor blades about a rotatable main shaft of the gas turbine engine. The main shaft is aligned in an axial direction of the gas turbine engine. A shroud assembly is coupled to the gas turbine engine. The shroud assembly includes a plurality of shroud segments circumferentially coupled about the rotor assembly such that a shroud spacing gap is formed in the axial direction between adjacent shroud segments. A cooling fluid source is coupled to each shroud segment such that cooling fluid is channeled through each shroud segment into a corresponding shroud spacing gap to facilitate positive purge flow through the shroud spacing gap.

20 Claims, 4 Drawing Sheets

TURBINE SHROUD ASSEMBLY AND METHOD FOR ASSEMBLING A GAS TURBINE ENGINE

STATEMENT REGARDING FEDERALLY SPONSORED RESEARCH & DEVELOPMENT

The U.S. Government may have certain rights in this invention pursuant to contract number N00019-99-C-1175.

BACKGROUND OF THE INVENTION

This invention relates generally to gas turbine engines and, more particularly, to a turbine shroud assembly for gas turbine engines.

Many conventional turbine shroud assemblies utilize cooling fluid flow across or between shroud segments to facilitate cooling of the shroud segments. During gas turbine engine operation, the shroud segments thermally expand in a circumferential direction due to exposure to high temperatures associated with the engine operation. This thermal expansion results in a decrease in spacing between adjacent shroud segments. As the spacing between adjacent shroud segments decreases, the amount of cooling fluid flow also decreases. The decrease in cooling fluid flow prevents or limits cooling of the shroud segment faces and ultimately results in shroud segment distress, particularly at the circumferential end faces of the shroud segments. Further, such shroud segment distress may result in spallation of a ceramic shroud coating.

BRIEF DESCRIPTION OF THE INVENTION

In one aspect, the present invention provides a method for assembling a gas turbine engine. The method includes coupling a rotor assembly including a plurality of rotor blades about a rotatable main shaft of the gas turbine engine aligned in an axial direction of the gas turbine engine. A shroud assembly is coupled to the gas turbine engine. The shroud assembly includes a plurality of shroud segments circumferentially coupled about the rotor assembly such that a shroud spacing gap is formed in the axial direction between adjacent shroud segments. A cooling fluid source is coupled to each shroud segment such that cooling fluid is channeled through each shroud segment into a corresponding shroud spacing gap to facilitate positive purge flow through the shroud spacing gap.

In another aspect, a shroud segment is provided. The shroud segment includes a first end face defined between a leading edge of the shroud segment and an opposing trailing edge of the shroud segment in an axial direction. The first end face is further defined between an inner radial edge of the shroud segment and an opposing outer radial edge of the shroud segment in a radial direction substantially perpendicular to the axial direction. A first end step is formed along at least a portion of the first end face in the axial direction and extends radially outwardly from the inner radial edge along at least a portion of the first end face in the radial direction. At least a portion of the first end step has a first step surface substantially parallel to and offset with respect to the first end face. At least one first cooling bore extends between an outer radial surface of the shroud segment and the first step surface. The at least one first cooling bore forms an opening positioned within the first step surface.

In another aspect, the present invention provides a shroud assembly circumferentially positioned about a rotor assembly of a gas turbine engine. The shroud assembly includes a first shroud segment. The first shroud segment includes a first end face defined between a leading edge of the first shroud segment and an opposing trailing edge of the first shroud segment in an axial direction, and between an inner radial edge of the first shroud segment and an opposing outer radial edge of the first shroud segment in a radial direction substantially perpendicular to the axial direction. A first end step is formed along at least a portion of the first end face in the axial direction and extends radially outwardly from the inner radial edge along at least a portion of the first end face in the radial direction. At least a portion of the first end step has a first step surface substantially parallel to and offset with respect to the first end face. At least one first cooling bore extends between an outer radial surface of the first shroud segment and the first step surface. The at least one first cooling bore is positioned within the first step surface. A second shroud segment has a first end face coupled to the first end face of the first shroud segment. A shroud spacing gap is at least partially defined by the first end step between the first shroud segment and the second shroud segment.

DETAILED DESCRIPTION OF THE INVENTION

The present invention provides a turbine shroud assembly including a plurality of shroud segments coupled circumferentially about a rotor assembly within a high pressure gas turbine engine. The turbine shroud assembly facilitates a positive purge flow through and/or between adjacent shroud segments to prevent or limit shroud end face distress during gas turbine engine operation. The turbine shroud assembly may include shroud segments with or without a coating, such as a suitable ceramic coating. With shroud segments coated with a ceramic material, the turbine shroud assembly of the present invention prevents or limits ceramic spalling associated with conventional ceramic-coated shroud segments. Additionally, by providing positive purge flow through and/or between adjacent shroud segments, minor contact between adjacent shroud segments may be tolerable, which may prevent or decrease shroud leakage flow.

The present invention is described below in reference to its application in connection with and operation of a gas turbine engine. However, it will be obvious to those skilled in the art and guided by the teachings herein provided that the shroud assembly of the present invention is likewise applicable to any combustion device including, without limitation, boilers, heaters and other turbine engines, having coated or uncoated shroud segments.

Figure 1:
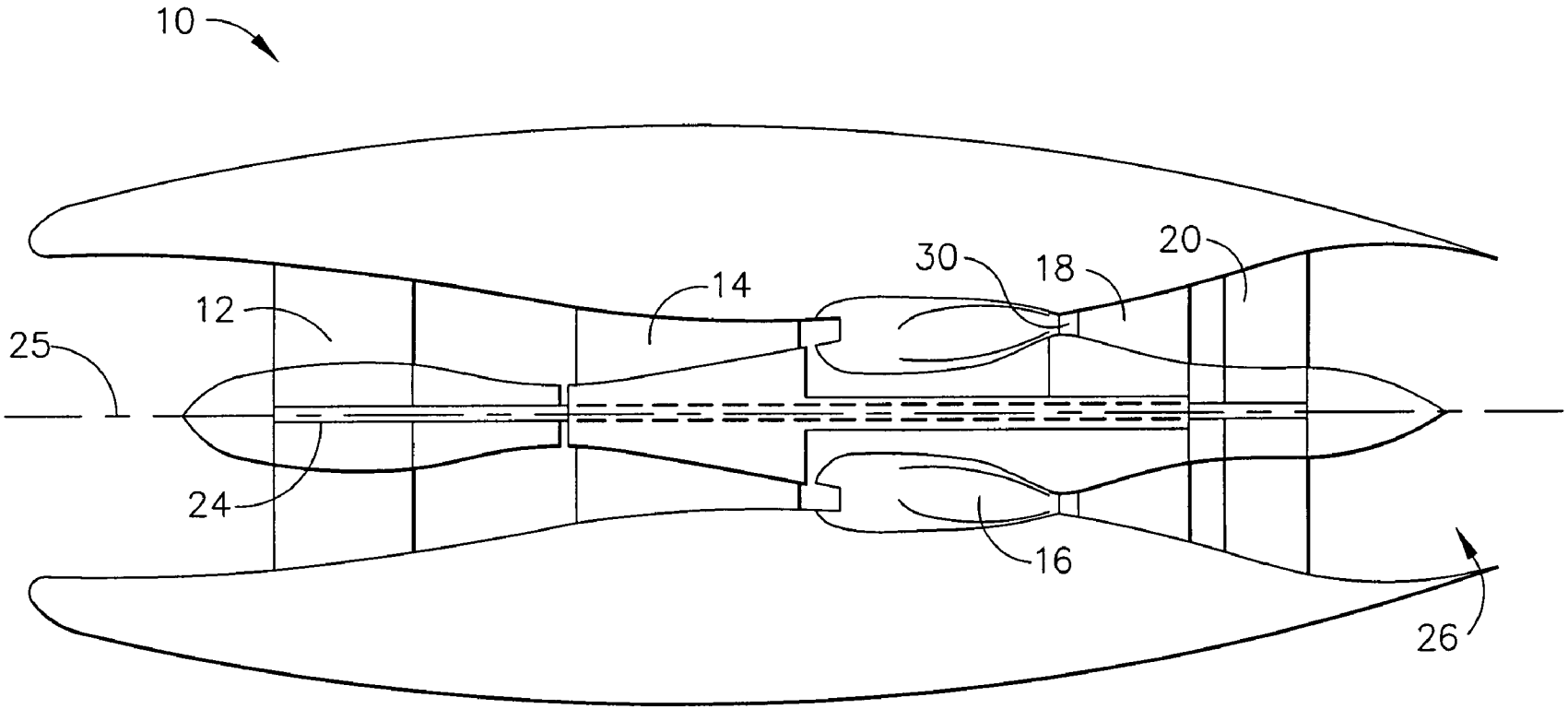
FIG. 1 is schematic side view of a gas turbine engine, according to one embodiment of this invention.

FIG. 1 is a schematic illustration of a gas turbine engine 10 including a fan assembly 12, a high pressure compressor 14, and a combustor 16. Gas turbine engine 10 also includes a high pressure turbine 18 and a low pressure turbine 20. In one embodiment, gas turbine engine 10 is a F414 engine available from General Electric Company, Cincinnati, Ohio.

In operation, air flows through fan assembly 12 and compressed air is supplied from fan assembly 12 to high pressure compressor 14. The highly compressed air is delivered to combustor 16. The combustion exit gases are delivered from combustor 16 to a turbine nozzle assembly 22. Airflow from combustor 16 drives high pressure turbine 18 and low pressure turbine 20 coupled to a rotatable main turbine shaft 24 and exits gas turbine engine 10 through an exhaust system 26.

In one embodiment, the combustion gases are channeled through turbine nozzle segments 32 to high pressure turbine 18 and/or low pressure turbine 20 shown in FIG. 1. More specifically, the combustion gases are channeled through turbine nozzle segments 32 to turbine rotor blades 34 which drive high pressure turbine 18 and/or low pressure turbine 20. In one embodiment, a plurality of rotor blades 34 forms a high pressure compressor stage of gas turbine engine 10. Each rotor blade 34 is mounted to a rotor disk (not shown). Alternatively, rotor blades 34 may extend radially outwardly from a disk (not shown), such that a plurality of rotor blades 34 form a blisk (not shown).

Figure 2:
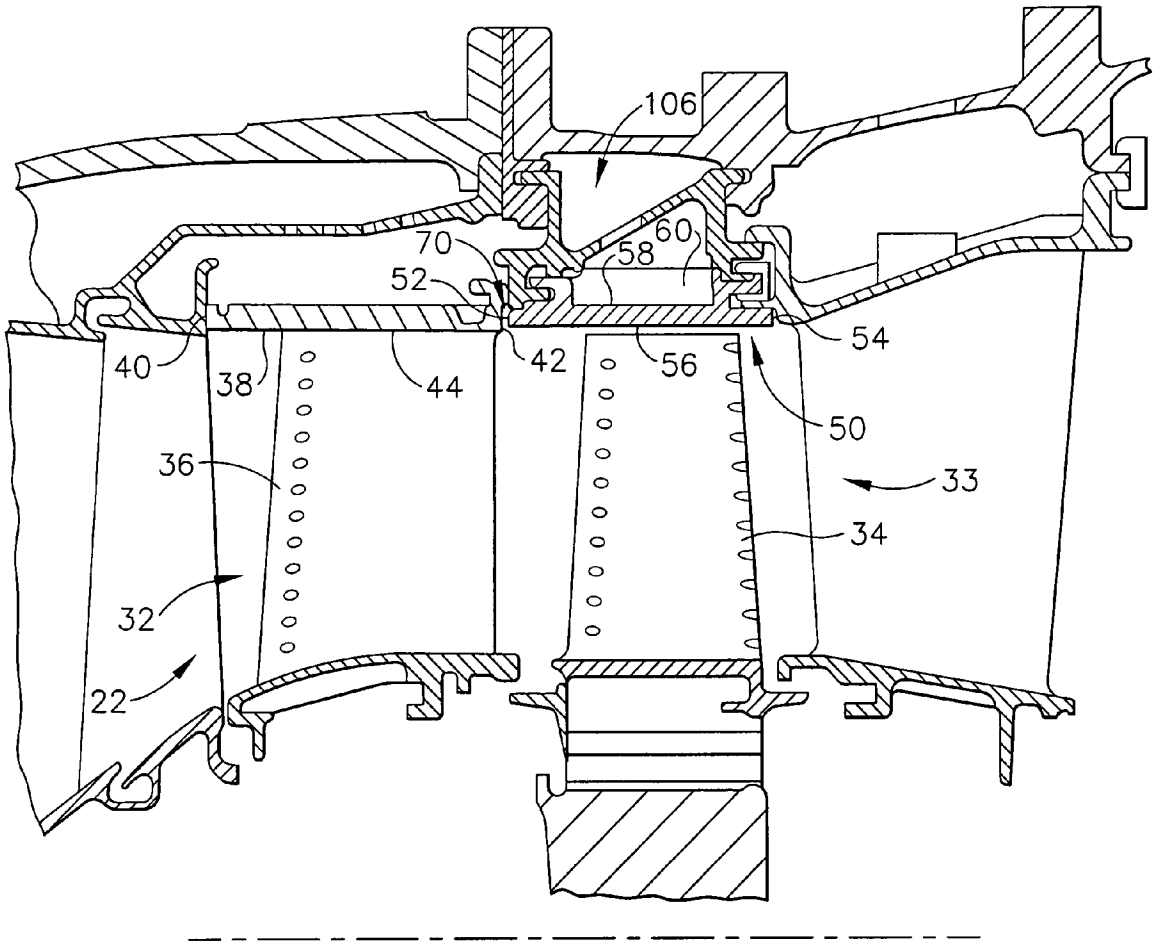
FIG. 2 is a partial sectional view of a gas turbine engine, according to one embodiment of this invention.

FIG. 2 is a partial sectional view of a turbine nozzle assembly 22 of gas turbine engine 10. In one embodiment, a plurality of turbine nozzle segments 32 are circumferentially coupled together to form turbine nozzle assembly 22. Nozzle segment 32 includes a plurality of circumferentially-spaced airfoil vanes 36 coupled together by an arcuate radially outer band or platform 38, and an opposing arcuate radially inner band or platform (not shown). More specifically, in this embodiment, outer band 38 and the opposing inner band are integrally-formed with airfoil vanes 36, and each nozzle segment 32 includes two airfoil vanes 36. In such an embodiment, nozzle segment 32 is generally known as a doublet. In an alternative embodiment, nozzle segment 32 includes a single airfoil vane 36 and is generally known as a singlet. In yet another alternative embodiment, nozzle segment 32 includes more than two airfoil vanes 36.

As shown in FIG. 2, outer band 38 includes a front or upstream face 40, a rear or downstream face 42 and a radially inner surface 44 extending therebetween. Inner surface 44 defines a flow path for combustion gases to flow through turbine nozzle assembly 22. In one embodiment, the combustion gases are channeled through nozzle segments 32 to high pressure turbine 18 and/or low pressure turbine 20. More specifically, the combustion gases are channeled through turbine nozzle segments 32 to turbine rotor blades 34 which drive high pressure turbine 18 and/or low pressure turbine 20.

A turbine shroud assembly 50 extends circumferentially around a rotor assembly 33 including a plurality of rotor blades 34. Turbine shroud assembly 50 includes a front or upstream face 52, a rear or downstream face 54 and a radially inner surface 56 extending therebetween. An outer radial surface 58 generally opposes radially inner surface 56. Inner surface 56 defines a flow path for combustion gases to flow through high pressure turbine 18 and/or low pressure turbine 20. In one embodiment, a plurality of similar or identical turbine shroud segments 60 are circumferentially coupled together to form turbine shroud assembly 50. In this embodiment, a shroud spacing gap 62 is defined in the axial direction between adjacent shroud segments 60 to facilitate thermal expansion of adjacent shroud segments 60 and/or turbine shroud assembly 50 in a circumferential direction during gas turbine engine operation. Further, in one embodiment, a gap 70 is defined between turbine shroud front face 52 and turbine nozzle rear face 42. Gap 70 facilitates thermal expansion of turbine shroud assembly 50 and/or turbine nozzle assembly 22 in the axial direction.

Figure 3:
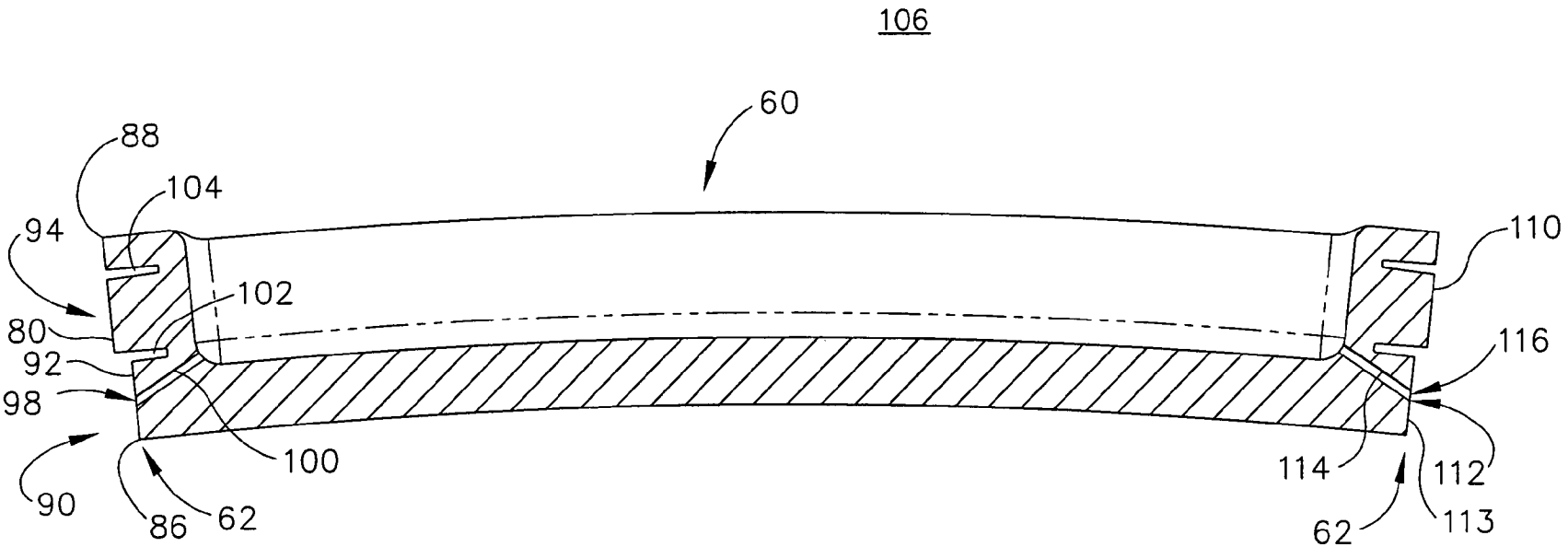
FIG. 3 is a front view of a shroud segment, according to one embodiment of this invention.
Figure 4:
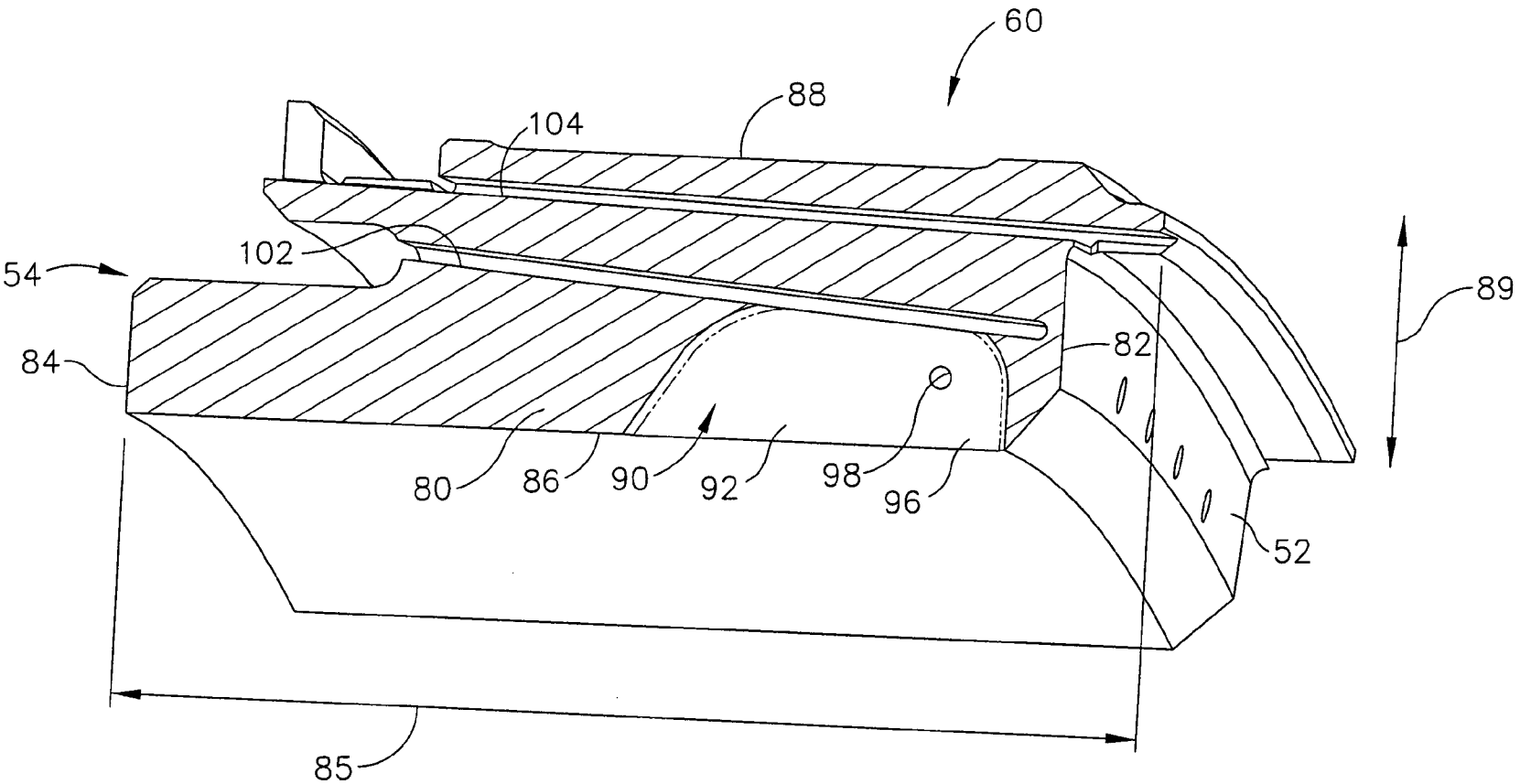
FIG. 4 is a side view of a shroud segment, according to one embodiment of this invention.

FIGS. 3 and 4 show a partial front view and a side view, respectively, of shroud segment 60. Shroud segment 60 includes a first end face 80 and an opposing second end face. In one embodiment, the second end face is similar or identical to first end face 80, as described below. Referring further to FIG. 4, first end face 80 is defined between a leading edge 82 of shroud segment 60, at least partially defining front face 52 of turbine shroud assembly 50, and an opposing trailing edge 84 of shroud segment 60, at least partially defining rear face 54 of turbine shroud assembly 50, in an axial direction as shown by directional line 83 in FIG. 4. First end face 80 is further defined between an inner radial edge 86 of shroud segment 60, at least partially defining inner surface 56 of turbine shroud assembly 50, and an opposing outer radial edge 88 of shroud segment 60, at least partially defining outer radial surface 58 of turbine shroud assembly 50, in a radial direction as shown by directional line 89 in FIG. 4. The radial direction is substantially perpendicular to the axial direction.

Referring to FIGS. 3 and 4, a first end step 90 is formed along at least a portion of first end face 80. In one embodiment, at least a portion of first end step 90 has a first step surface 92 substantially parallel to and offset with respect to first end face 80. First end step 90 and/or first step surface 92 extends radially outwardly from inner radial edge 86 along at least a portion of first end face 80 in the radial direction. In one embodiment, first end step 90 extends axially along first end face 80 between leading edge 82 and trailing edge 84. In a particular embodiment, first step surface 92 extends substantially along first end face 80, i.e. from leading edge 82 to trailing edge 84, such that first step surface 92 partially forming first end step 90 is circumferentially offset with respect to a radially outer portion 94 of first end face 80, as shown in FIG. 3. In an alternative embodiment, first end step 90 defines or forms a notch or depression 96 in first end face 80, as shown in FIG. 4. In this embodiment, depression 96 extends along only a portion of first end face 80 in the axial direction. First step surface 92 surrounds an opening 98 formed by at least one first cooling bore 100 formed through shroud segment 60, as described below, and terminates radially outwardly of opening 98. First cooling bore 100 is configured to direct cooling fluid through shroud segment 60. In a particular embodiment, at least one cooling bore 100 is positioned proximate leading edge 82.

As shown in FIGS. 3 and 4, shroud segment 60 forms or includes at least one seal slot 102 for coupling adjacent shroud segments 60 together. In one embodiment, shroud segment 60 includes an inner or first seal slot 102 and an outer or second seal slot 104. First end step 90 extends radially outwardly from inner radial edge 86 such that at least a portion of first end step 90 extends between inner radial edge 86 and inner seal slot 102. Referring to FIG. 3, in a particular embodiment, first end step 90 extends substantially between inner radial edge 86 and inner seal slot 102 along an axial length of first end face 80. In an alternative embodiment, first end step 90 extends along only a portion of the axial length of first end face 80 with only a portion of first end step 90 extending substantially between inner radial edge 86 and inner seal slot 102, as shown in FIG. 4.

With the plurality of turbine shroud segments 60 circumferentially coupled to form turbine shroud assembly 50, first end step 90 forms at least a portion of shroud spacing gap 62 defined between adjacent shroud segments 60. In one embodiment, first end step 90 forms shroud spacing gap 62 between adjacent, coupled shroud segments 60. In an alternative embodiment, first end step 90 forms a portion of shroud spacing gap 62 and a cooperating end step formed in adjacent, coupled shroud segment 60 forms a remaining portion of shroud spacing gap 62. Shroud spacing gaps 62 defined between adjacent shroud segments 60 provide positive purge flow during operating conditions to prevent or limit shroud end face distress. Further, shroud spacing gaps 62 may facilitate expansion of shroud segment 60 with respect to adjacent shroud segments 60 due to thermal conditions during operation.

As shown in FIGS. 3 and 4, at least one cooling bore 100 provides flow communication between a suitable cooling fluid source, such as an air plenum 106, and shroud spacing gap 62 to channel cooling fluid through shroud segment 60 into corresponding shroud spacing gap 62 to facilitate positive purge flow through shroud spacing gaps 62 positioned circumferentially about rotor blades 34. In one embodiment, air plenum 106 is in flow communication with high pressure compressor 14 to provide cooling fluid to turbine shroud assembly 50 and/or each shroud segment 60. In alternative embodiments, any suitable source of cooling fluid is in flow communication with turbine shroud assembly 50 to provide cooling fluid to each shroud segment 60.

In one embodiment, cooling bore 100 extends between outer radial surface 58 of shroud segment 60 and first step surface 92. As shown in FIGS. 3 and 4, cooling bore 100 forms opening 98 positioned within first step surface 92. In this embodiment, cooling bore 100 provides flow communication between a suitable cooling fluid source, such as air plenum 106, and shroud spacing gap 62 to provide positive purge flow through shroud spacing gaps 62 positioned circumferentially about rotor blades 34.

In one embodiment, shroud segment 60 includes a second end face 110 opposing first end face 80. In this embodiment, second end face 110 is similar or identical to first end face 80. Second end face 110 is defined between leading edge 82 and trailing edge 84 in the axial direction, and between inner radial edge 86 and outer radial edge 88 in the radial direction. A second end step 112 is formed along at least a portion of second end face 110 in the axial direction and extends radially outwardly from inner radial edge 86 along at least a portion of second end face 110. At least a portion of second end step 112 has a second step surface 113 that is substantially parallel to and offset with respect to second end face 110. Second end step 112 at least partially defines a shroud spacing gap 62.

At least one second cooling bore 114 extends between outer radial surface 58 and second step surface 113. Second cooling bore 114 forms an opening 116 positioned within second step surface 113 and is configured to direct cooling fluid through shroud segment 60. In a particular embodiment, at least one second cooling bore 114 is positioned proximate leading edge 82. Second cooling bore 114 provides flow communication between a cooling fluid source, such as air plenum 106, and shroud spacing gap 62 to facilitate positive purge flow through shroud spacing gaps 62 positioned circumferentially about rotor blades 34.

In one embodiment, a method for assembling gas turbine engine 10 is provided. The method includes coupling rotor assembly 33 about rotatable main shaft 24 of gas turbine engine 10. Main shaft 24 is aligned with a longitudinal axis 25 of gas turbine engine 10 in an axial direction, as shown in FIG. 1. In this embodiment, rotor assembly 33 includes a plurality of rotor blades 34 coupled to main shaft 24 and rotatable with main shaft 24 during operation of gas turbine engine 10.

A shroud assembly 50 is coupled to gas turbine engine 10. Shroud assembly 50 includes a plurality of shroud segments 60 that are coupled and circumferentially positioned about rotor assembly 33 such that shroud spacing gap 62 is formed in the axial direction between adjacent shroud segments 60. In one embodiment, first end step 90 is formed in first end face 80 of shroud segment 60 such that first end step 90 at least partially defines shroud spacing gap 62. At least one cooling bore 100 is formed through shroud segment 60 to extend between outer radial surface 58 of shroud segment 60 and first step surface 92. Cooling bore 100 forms opening 98 positioned within first step surface 92, as shown in FIGS. 3 and 4.

A cooling fluid source is coupled to each shroud segment 60 such that cooling fluid is channeled through each shroud segment 60 into a corresponding shroud spacing gap 62 to facilitate positive purge flow through shroud spacing gap 62 during operation of gas turbine engine 10. In one embodiment, at least one cooling bore 100 is formed between outer radial surface 58 of each shroud segment 60 and first step surface 92 substantially parallel to offset with respect to first end face 80 of shroud segment 60. Cooling bore 100 provides flow communication between the cooling fluid source and shroud spacing gap 62.

In one embodiment, shroud segment 60 includes second end face 110 opposing first end face 80. Second end face 110 is similar or identical to first end face 80 and is defined between leading edge 82 and trailing edge 84 in the axial direction, and between inner radial edge 86 and outer radial edge 88 in the radial direction. Second end step 112 is formed along at least a portion of second end face 110 in the axial direction and extends radially outwardly from inner radial edge 86 along at least a portion of second end face 110. Second end step 112 at least partially defines a shroud spacing gap 62. At least one second cooling bore 114 extends between outer radial surface 58 and second step surface 113. Second cooling bore 114 forms opening 116 positioned within second step surface 113 and is configured to direct cooling fluid through shroud segment 60. In a particular embodiment, at least one second cooling bore 114 is positioned proximate leading edge 82. Second cooling bore 114 provides flow communication between the cooling fluid source and shroud spacing gap 62 to facilitate positive purge flow through shroud spacing gaps 62 positioned circumferentially about rotor blades 34.

The above-described turbine shroud assembly and method for assembling a gas turbine engine allows positive purge flow between adjacent shroud segments forming the turbine shroud assembly to prevent shroud segment end face distress. More specifically, an end step is formed in the shroud segment end face and a cooling bore is formed through the shroud segment to provide flow communication between a cooling fluid source and a shroud spacing gap at least partially defined by the end step. As a result, the turbine shroud assembly provides positive purge flow at operating conditions.

Exemplary embodiments of a turbine shroud assembly and a method for assembling a gas turbine engine are described above in detail. The turbine shroud assembly and the method for assembling a gas turbine engine is not limited to the specific embodiments described herein, but rather, components of the assembly and/or steps of the method may be utilized independently and separately from other components and/or steps described herein. Further, the described assembly components and/or the method steps can also be defined in, or used in combination with, other assemblies and/or methods, and are not limited to practice with only the assembly and/or method as described herein.

While the invention has been described in terms of various specific embodiments, those skilled in the art will recognize that the invention can be practiced with modification within the spirit and scope of the claims.

What is claimed is:

1. A method for assembling a gas turbine engine, said method comprising:

coupling a rotor assembly including a plurality of rotor blades about a rotatable main shaft of the gas turbine engine aligned in an axial direction of the gas turbine engine;

coupling a shroud assembly to the gas turbine engine, the shroud assembly comprising a plurality of shroud segments circumferentially coupled about the rotor assembly such that a shroud spacing gap is formed in the axial direction between adjacent shroud segments, wherein the shroud spacing gap extends from at least one of a radially inner edge and a radially outer edge of the shroud segment to a seal slot defined in an end face of the shroud segment, and wherein the seal slot extends from downstream of a leading edge of the shroud segment partially towards a trailing edge of the shroud segment; and coupling a cooling fluid source to each shroud segment such that cooling fluid is channeled through each shroud segment into a corresponding shroud spacing gap to facilitate positive purge flow through the shroud spacing gap.

2. A method in accordance with claim 1 wherein coupling a shroud assembly to the gas turbine engine further comprises:

forming a first end step in a first end face of each shroud segment such that the first end step at least partially defines the shroud spacing gap, the first end step having a first step surface substantially parallel to and offset with respect to the first end face; and forming at least one cooling bore extending between an outer radial surface of each shroud segment and the corresponding first end face such that the at least one cooling bore is positioned within the first end step.

3. A method in accordance with claim 1 wherein coupling a cooling fluid source to each shroud segment such that cooling fluid is channeled through each shroud segment into a corresponding shroud spacing gap further comprises forming at least one cooling bore between an outer radial surface of each shroud segment and an end step formed in an end face of the shroud segment, the at least one cooling bore providing flow communication between the cooling fluid source and the shroud spacing gap.

4. A shroud segment comprising:

a first end face defined between a leading edge of said shroud segment and an opposing trailing edge of said shroud segment in an axial direction, and between an inner radial edge of said shroud segment and an opposing outer radial edge of said shroud segment in a radial direction substantially perpendicular to said axial direction;

a slot defined within said first end face, wherein the slot extends from downstream of said leading edge partially towards said trailing edge, said slot sized to receive a seal;

a first end step formed along at least a portion of said first end face in said axial direction and extending radially outwardly from said inner radial edge to said slot along at least a portion of said first end face, at least a portion of said first end step having a first step surface substantially parallel to and offset with respect to said first end face; and at least one first cooling bore extending between an outer radial surface of said shroud segment and said first step surface, said at least one first cooling bore forming an opening positioned within said first step surface.

5. A shroud segment in accordance with claim 4 further comprising:

a second end face opposing said first end face, said second end face defined between said leading edge and said trailing edge in said axial direction, and between said inner radial edge and said outer radial edge in said radial direction; and a second end step formed along at least a portion of said second end face in said axial direction and extending radially outwardly from said inner radial edge along at least a portion of said second end face, at least a portion of said second end step having a second step surface substantially parallel to and offset with respect to said second end face.

6. A shroud segment in accordance with claim 5 further comprising at least one second cooling bore extending between said outer radial surface and said second step surface, said at least one second cooling bore forming an opening positioned within said second step surface.

7. A shroud segment in accordance with claim 4 wherein said first end step forms at least a portion of a shroud spacing gap defined between said shroud segment and an adjacent shroud segment.

8. A shroud segment in accordance with claim 4 wherein said at least one first cooling bore provides flow communication between an air plenum and a shroud spacing gap formed between said shroud segment and an adjacent shroud segment.

9. A shroud segment in accordance with claim 4 wherein said first end step extends axially substantially along said first end face between said leading edge and said trailing edge.

10. A shroud segment in accordance with claim 4 wherein said first step surface comprises a depression formed on said first end face and surrounding an opening formed by said at least one first cooling bore, said depression extending partially along said first end face in said axial direction.

11. A shroud assembly circumferentially positioned about a rotor assembly of a gas turbine engine, said shroud assembly comprising:

a first shroud segment comprising:

a first end face defined between a leading edge of said first shroud segment and an opposing trailing edge of said first shroud segment in an axial direction, and between an inner radial edge of said first shroud segment and an opposing outer radial edge of said first shroud segment in a radial direction substantially perpendicular to said axial direction;

a slot defined in said first end face, wherein said slot extends from downstream of said leading edge partially towards said trailing edge of said first shroud segment, said slot sized to receive a seal;

a first end step formed along at least a portion of said first end face in said axial direction and extending radially outwardly from said inner radial edge to said slot along at least a portion of said first end face, at least a portion of said first end step having a first step surface substantially parallel to and offset with respect to said first end face; and at least one first cooling bore extending between an outer radial surface of said first shroud segment and said first step surface, said at least one first cooling bore defining an opening within said first step surface;

a second shroud segment having a first end face coupled to said first end face of said first shroud segment; and a shroud spacing gap at least partially defined by said first end step between said first shroud segment and said second shroud segment, said at lest one first cooling bore providing flow communication between a cooling fluid source and said shroud spacing gap.

12. A shroud assembly in accordance with claim 11 wherein said first step surface extends substantially along a length of said first end face in said axial direction.

13. A shroud assembly in accordance with claim 11 wherein said first end step forms a depression on said first end face, said depression surrounding said at least one first cooling bore.

14. A shroud assembly in accordance with claim 11 wherein said first shroud segment further comprises:

a second end face opposing said first end face, said second end face defined between said leading edge and said trailing edge in said axial direction, and between said inner radial edge and said outer radial edge in said radial direction; and a second end step formed along at least a portion of said second end face in said axial direction and extending radially outwardly from said inner radial edge along at least a portion of said second end face, at least a portion of said second end step having a second step surface substantially parallel to and offset with respect to said second end face.

15. A shroud assembly in accordance with claim 14 further comprising at least one second cooling bore extending between said first shroud segment outer radial surface and said second step surface, said at least one second cooling bore defining an opening within said second step surface.

16. A shroud assembly in accordance with claim 11 wherein said second shroud segment further comprises:

a slot defined in said second shroud segment first end face;

a second end step formed along at least a portion of said second shroud segment first end face in said axial direction and extending radially outwardly from said inner radial edge to said slot along at least a portion of said second shroud segment first end face, said second end step partially defining said shroud spacing gap; and at least one second cooling bore extending between an outer radial surface of said second shroud segment and a second step surface of said second shroud segment first end face, said at least one second cooling bore defining an opening within said second step surface.

17. A shroud assembly in accordance with claim 11 wherein said at least one first cooling bore is configured to direct cooling fluid through said first shroud segment.

18. A shroud assembly in accordance with claim 11 wherein said at least one first cooling bore is positioned proximate said leading edge.

19. A method in accordance with claim 1 wherein coupling a shroud assembly to a gas turbine engine further comprises coupling the shroud assembly to the gas turbine engine such that the shroud spacing gap is at least partially defined by a step surface formed along at least a portion of an end face of one of the adjacent shroud segments.

20. A method in accordance with claim 1 wherein coupling a shroud assembly to a gas turbine engine frirther comprises coupling the shroud assembly to the gas turbine engine such that the shroud spacing gap extends to a leading edge of the shroud segment.

* * * * *